United States Patent [19]

Radtke et al.

[11] Patent Number: 4,637,184

[45] Date of Patent: Jan. 20, 1987

[54] HOLLOW FLOOR

[76] Inventors: Wolfgang Radtke, Nachtigallenweg 46, D-5063 Steinenbrück; György Borbely, Schaevenstr. 6, D-5014 Kerpen-Mödrath; Sebald Pallhorn, AM Geisberg 30, D-8752 Goldbach; Erich Höllfritsch, Rainwiesenweg 21, D-8501 Behringersdorf, all of Fed. Rep. of Germany

[21] Appl. No.: 754,194

[22] Filed: Jul. 10, 1985

Related U.S. Application Data

[63] Continuation of Ser. No. 343,309, Jan. 27, 1982, abandoned.

[30] Foreign Application Priority Data

Feb. 4, 1981 [DE] Fed. Rep. of Germany ..... 3103632

[51] Int. Cl.[4] ..... E04F 15/02; E04B 5/48; E04G 11/04

[52] U.S. Cl. ..... 52/220; 52/2; 52/508; 52/577; 52/741; 52/323; 52/382; 52/383; 52/408; 249/65; 264/314; 264/316; 264/333

[58] Field of Search ..... 52/220, 221, 741, 303, 52/382, 383, 408, 508, 577, 2

[56] References Cited

U.S. PATENT DOCUMENTS

| | | | |
|---|---|---|---|
| 2,792,164 | 5/1957 | Canffiel | 52/577 X |
| 2,956,785 | 10/1960 | Riehl | 52/220 X |
| 3,288,998 | 11/1966 | Press, Jr. | 52/303 X |
| 3,334,458 | 8/1967 | Leemhuis | 52/220 X |
| 4,076,872 | 2/1978 | Lewicki et al. | 52/2 X |

FOREIGN PATENT DOCUMENTS

| | | | |
|---|---|---|---|
| 417008 | 1/1967 | Switzerland | 52/303 |

*Primary Examiner*—Alfred C. Perham

*Attorney, Agent, or Firm*—Spensley Horn Jubas & Lubitz

[57] ABSTRACT

A cavity floor is formed by placing on a structural floor bottom a flexible floor mold which has leg forming portions arranged in an array with generally planar portions extending between and surrounding the leg forming portions. A flowable substance is applied over the mold, which subsequently hardens to form an upper floor having a plurality of legs defined by the leg forming portions, with a cavity region therebetween. The planar portions of the flexible floor mold permit adjacent leg forming portions each separately to contact the floor bottom under the weight of the applied flowable substance, even if the floor bottom is uneven.

22 Claims, 7 Drawing Figures

HOLLOW FLOOR

This is a continuation of application Ser. No. 343,309 filed Jan. 27, 1982, abandoned.

The invention relates to a hollow floor comprising a floor top resting via load-bearing feet on a floor bottom and forming with the floor bottom a hollow space, as well as a process for the manufacture of a hollow floor and a sheet material to perform the process.

A known hollow floor (DE-OS No. 23 07 815) consists of a floor bottom covered with a heat insulating layer and a floor top composed of plates and mounted at a distance above the heat insulating layer. The plates of the floor top are resting on the floor bottom by means of supports adjustable in height. Hot air is conducted into the hollow floor for heating purposes in order to effect a direct floor heating. The room heating is realised by the thermal conductivity of the plates forming the floor top.

As a rule, the floor bottom consists of a concrete material which normally has an uneven surface, the uneven points being compensated by load-bearing feet adjustable in height which need be adjusted individually so as to uniformly level the plate forming the floor top. The adjusting work at the load-bearing feet takes a lot of time. Moreover, said load-bearing feet adjustable in height are also very expensive. In addition, as another disadvantage of the known hollow floor, the plates are only supported at the corner points thus calling for a high stability and bearing capacity of the panels. Lastly, in the known hollow floor, the hollow space is an open space in total in which air spreads without an accompanying canalization or air circulation. As a result, the flow speeds developed in the hollow space are different, e.g. in the corner regions, they are substantially inferior to those on the direct path between the air entry and the air outlet.

It is the object of the invention to provide a hollow floor of the type mentioned at the outset hereof comprising a construction and production which are much simpler than with the known hollow floors while a better heat transfer from the air to the floor top is possible at the same time.

To solve said problem it is provided according to the invention that the load-bearing feet are integrally formed with the floor surface.

The load-bearing feet as well as the floor top consisting of a good conducting material e.g. concrete or Estrich plaster, which considerably contributes to an increased thermal introduction. The arrangement of the load-bearing feet beneath the floor top is independent from the probable panel size and not confined to the corner regions of the panels. Therefore, the width between two load-bearing feet can be reduced greatly, thus calling for minor requirements concerning tensile and flexural strength of the material of the floor top. It being possible for the number or the surface of the load-bearing feet per surface unit to be relatively great and the arrangement of the load-bearing feet to be freely selectable, said feet can be also used to canalize the air thus conducting the main air volume along defined paths, by increasing in one preferred direction of the hollow space the flow resistance to be greater than in transverse direction thereto, due to the load-bearing feet.

After all, due to the great number of load-bearing feet, the air is whirled thus improving the heat transfer from the air to the floor top including the load-bearing feet.

In an advantageous embodiment of the invention, the load-bearing feet of the hollow floor contain incorporated filling bodies which, subject to their type, contribute to an increase or reduction of heat storage. Said filling bodies may consist of bulk material such as rubble or metal grains which material adapts itself to the formwork of the feet or of prefabricated blocks which determine or contribute to the shape of the load-bearing feet. Due to such filling bodies the formation of troughs due to shrinkage above the load-bearing feet upon the casting of the floor top is avoided.

A hollow floor frequently contains cables, hose lines and other conduits which must be laid beneath the floor top If the hollow spaces of the hollow floor are of a reduced height, it may be difficult to subsequently introduce such lines and to either advance them within the hollow floor or to string them with a previously introduced tension cable through the hollow floor. There is always the risk for the line to be laid in the hollow floor to come into frictional contact with the load-bearing feet or to be jammed thus obstructing the introduction of the line. Above all, if the line is to be laid straight in the hollow floor, the load-bearing feet of the hollow floor may give rise to hooks, jamming and angular frictions. To facilitate the introduction of lines etc. into the hollow floor, the load-bearing feet are provided with a smooth coating according to a preferred embodiment of the invention. Such a smooth coating may be a sheet of metal or plastic or of another smooth cover. It reduces the friction with the lines to be introduced into the hollow floor.

To reduce friction in regard to cables and hose lines etc. the floor bottom may contain a smooth coating as well, which preferably consists of a relatively hard pressure distributing layer mounted on a relatively soft insulating layer, serving for thermal and sound insulation. The insulating layer is made of soft material such as foam or glass fiber plates. The surface of such a soft material causing a good thermal and sound insulation in downward direction is relatively soft. Therefore, it is covered with the pressure distributing layer supporting the feet of the floor top The pressure of the feet is distributed through the pressure distributing layer over a larger area of the insulating layer which does not suffer from local impressions accordingly.

The pressure distributing layer is provided with holes for sound absorption so as to avoid progressing in the hollow floor of a sound transmitted by air which sound was caused for instance by air flow. The sound transmitted by air passes through the holes into the insulating layer to be absorbed there. By this means, multiple reflections of the sound transmitted by air are avoided.

According to another preferred embodiment of the invention, at least some load-bearing feet are provided with a coating of a heat-reflecting material which, at the same time, may form the above mentioned smooth surface, while it simultaneously provides a thermal function. In a hollow floor used for heating purposes, there is frequently an undesired heat distribution. For instance, the entry points of the hot air in the hollow floor are heated most of all while the points away from the entry points are least heated. On the other hand, some zones in a building, e.g. floors, require lower temperatures. To achieve a positive heat distribution, the hollow space of the hollow floor is provided with a heat-reflecting coating in the areas proposed for a reduced heat transfer, to avoid yielding through such a coating too much heat to the floor top. It is not necessary to confine the heat-reflecting layer to the load-bearing feet, but it can be used generally as a separating layer between the hollow spaces and the floor top. Due to the fact that some regions of the hollow floor are provided with such a heat-reflecting layer while other regions do not contain it, the surface heat yielded by the hollow floor is distributed under control.

According to another preferred embodiment of the invention, the peripheral walls of the load-bearing feet meet with the floor bottom in a substantially vertical direction. Preferably the peripheral walls of the load-bearing feet continuously enlarge to the top and smoothly blend into the horizontal floor top. Due to the nearly vertical extension of the peripheral walls onto the floor bottom, keys and wedges are avoided by which the lines when laid are subjected to jamming. The arched configuration of the hollow spaces also involves advantages for the introduction of cables and lines into the hollow floor because no plane surfaces are existing which could cause an accumulation of the lines. The free end of an inserted line is always guided along a round surface when it abuts at a point.

Another advantage of the arched construction of the hollow spaces resides in the fact that due to the good static bearing capacity it is possible to obtain the greatest possible effective height of the hollow spaces with a relative reduced thickness of the floor top. After all, the arched structure also has a sound insulating effect. An airborne noise caused in the hollow floor is refracted at the walls of the vault by a great number of different angles of reflection to be finally absorbed by the floor bottom.

The continuous reduction of the diameter of the load-bearing feet from the top to the bottom also results in an impact sound insulation. Due to the arched underside of the floor top the impact sound caused during walking is repeatedly reflected in the floor top to be finally absorbed without progressing substantially in the floor top. The change of cross section of the load-bearing feet also inhibits sound resoncances.

The invention also relates to a process for the production of the hollow floor of the stated type. Such a process consists in the fact that on the floor bottom, there is provided formwork of a profiled flat material substantially adapting to the contour of the floor bottom and being covered subsequently with a plastic composition forming upon its curing the top floor and the load-bearing feet.

The material of the formwork is so flexible and ductile that it adapts to probable uneven points of the floor bottom when loaded with Estrich plaster. The flat material is covered with the plastic composition which does not only fill the downwardly directed bulges later forming the load-carrying feet, but it also forms the floor top.

In the mentioned process, leveling is performed at the surface of the floor top rather than at the load-bearing feet carrying the floor top. Thus, leveling operations required otherwise are not necessary.

The formwork consisting of the sheet material prevents the flowable composition from penetrating. Therefore, it must have such a density that the underside of the floor top and the external sides of the load-bearing feet are formed while, at the same time no substantial amount of flowable substance can get into the hollow space formed between the flat material and the floor bottom. Preferably, the flowable substance consists of a self-leveling suspension which automatically forms an exactly horizontal and smooth surface. However, the flowable composition can also be of a pasty consistency which would require, of course, a mechanical smoothing.

If the flat material remains on the floor top and at the load-bearing feet like a lost mold, it forms a coating of the wall of the hollow space. If such an insulating layer is undesirable, it can be provided in an advantageous embodiment of the process of the invention, with the use of a flat material of a thermoplastic foil or sheet that, upon the curing of the plastic composition, the plastic foil is shrunk, molten or burnt by heat. One only needs to pass said hot air through the hollow space, and the selected temperature must be as high as to cause a shrinkage or fusing of the plastic foil. As a result, the plastic foil will detach from the walls of the floor top and of the load-bearing feet so that its residues will be deposited loosely on the floor bottom, or, in case of shrinkage, a layer covering the floor bottom will be formed. The hollow space through which the air is conducted subsequently for heating or cooling purposes will be then present between the residues of the plastic foil and the underside of the floor top, thus permitting the direct contact between the air and the underside of the floor top without being hindered by an insulating layer. The residues of the plastic foil will form an insulation of the floor bottom thus additionally inhibiting the undesired heat transfer to the floor bottom.

As another advantage of the process, the thermoplastic foil which is also present between the undersides of the load-bearing feet and the floor bottom is bonding the load-bearing feet with the floor bottom during the hot air treatment thus excluding later displacements of the floor top relative to the floor bottom.

According to a second variant of the process of the invention it is provided that a cushion consisting of two foils interconnected regionwise is laid on the floor bottom to be filled with air or water, that the flowable substance is applied on the cushion and smoothed and that the cushion is evacuated upon the curing of the flowable substance.

This variant is advantageous because the filled cushion has a good bearing capacity so as to resist the weight of the flowable substance even with a great layer thickness of the floor top, on the one hand, and, on the other hand, during the application of the flowable substance, persons can step on the floor top without affecting the canal system.

Upon the curing of the composition applied first in a flowable condition, the cushion will be evacuated to collapse and to cover the upper side of the floor bottom. There is again the advantage of an additional thermal insulation of the floor bottom while air gets directly to the underside of the floor top.

In an advantageous configuration of the invention the cushion consists of a planar first sheet and of a second sheet forming bulges on the first sheet and being connected to the latter between the bulges, the second sheet not being self-supporting. The two sheets are forming in a way an air mattress having a substantially planar underside. In filled condition, the cushion forms a sheathing for the shaping of the underside of the floor top and of the load-bearing feet. Upon the curing of the composition applied on the cushion, the latter is evacuated and slackly rests on the floor bottom. Its seat on the floor bottom can be still reinforced by removing the filling of the cushion by suction. The canals formed above the empty cushion are free for ventilation.

The invention also relates to a sheet material for performing the process of the invention. Said sheet material consists of plates or webs comprising recesses spaced regularly, the edges or borders of two adjacent plates or webs forming sealable butt joint or overlapping zones.

The profiled sheet material can be available in the form of webs or plates; the webs or plates have to be joined sealingly to result in a continuous casting mold for the continuous floor top to be cast locally. Therefore, as a rule, the borders of the flat material are bar-shaped either intermeshing or straight to fit into each other. The flexible sheet material can be reinforced regionwise by additional fusible plastics or it can be combined with metal inlays to improve conductivity and stability.

In addition to the load-bearing feet the sheet material can contain other recesses which do not extend downwardly as far as the feet, to form air conducting elements. If the sheet material is available in plates, their recesses may result in a preferred direction for the air duct, it being possible to mount by twisting the plate in such a way that adjacent plates cause an air circulation into another direction.

In an alternative embodiment of the flat material, it consists of a metal sheet plate susceptible to deep-drawing, or of a foldable metal foil which remains inside the hollow floor—forming a coating of the floor top and of the load-bearing feet. The metal foil is a good heat conductor and does not substantially affect the heat transfer between air and the floor top to the underside of which it adheres firmly.

With reference to the drawings some embodiments of the invention are explained hereafter as follows.

Figure 1:
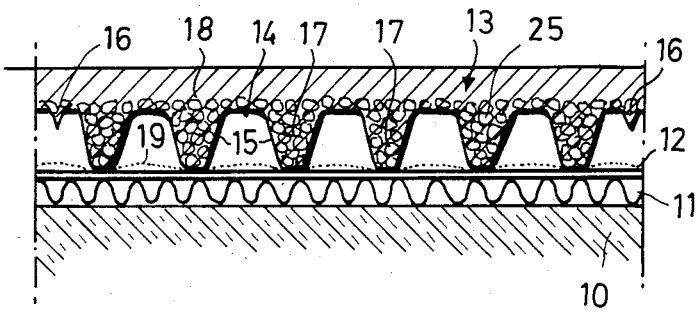
FIG. 1 is a cross section of a hollow floor.
Figure 2:
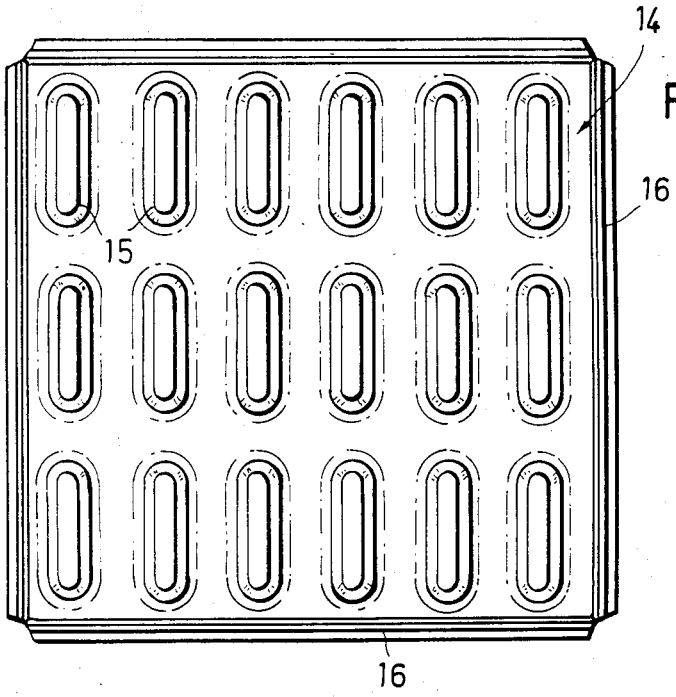
FIG. 2 is a plan view of a plastic panel such as used for the production of the hollow floor of FIG. 1.

The hollow floor as per cross section of FIG. 1 consists of the floor bottom 10,11,12 and the floor top 13 arranged above the it. The floor bottom 10,11,12 consists of a concrete plate 10, a heat insulating layer 11 arranged above it and a metal sheet 12 arranged above the heat insulating layer 11 for a better distribution of the load. The metal sheet 12 is provided with holes. To form the floor top 13, a mold 14 of a deep-drawn plastic foil is placed first on the floor bottom 10,11,12. The mold 14 is self-supporting. It has a plurality of knubs or ribs 15 projecting downwardly and, as shown in FIG. 2, being of an oblong shape according to the illustrated embodiment. The undersides of the ribs 15 are resting on the sheet plate 12. The mold 14 in total is flexible or pliable thus adapting to probable uneven points of the floor bottom 10,11,12.

The edges 16 of the mold 14 are designed as continuously uniformly profiled bars which are situated on the level of the prominent flat regions of the mold 14. The edges 16 have a groove-type extension to permit sealing engagement with another extension of an adjacent mold 14. In addition, the edges 16 can be interconnected by an adhesive or by welding so that the panels in total form a sealing casting mold for the floor top 13.

Filling bodies 25 of rubble are filled into the knubs or ribs 15 which project beyond the mold 14 into the region of the lateral floor top 13. The floor bottom, 10, 11, 12, may also contain filling bodies such as the filling bodies indicated at 25 in the concrete plate 10 or the insulating layer 11.

The floor top 13 is produced from a liquid Estrich plaster which is applied on the mold 14, to enclose and embed the filling bodies 25. At the same time, the load-bearing feet 17 are formed in the ribs 15 of the mold 14, and above the load-bearing feet 17 there is formed a layer 18 covering the total mold 14. If necessary, the surface of the liquid Estrich plaster is smoothed to form a horizontal face independent from the uneven points of the floor bottom 10,11,12. The height is adjusted in that, if necessary, the thickness of the layer 18 varies at different sites.

Upon a solidification of the liquid Estrich plaster, the mold 14 remains in the hollow floor thus forming a smooth coating closely surrounding the load-bearing feet 17. If electric cables or other conduits are introduced into the hollow space, they slide along the coating and do not contact the relatively rough concrete or mortar surface.

It is also possible to remove the mold 14 upon the final production of the top floor 13. To this end, hot air is blown into the hollow space formed between the floor bottom 10,11,12 and the floor top 13. As a result, the thermoplastic material of the mold 14 will shrink by causing, on the one hand, a bonding of the load-bearing feet with the metal sheet 12 at the undersides of the load-bearing feet 17, and, on the other hand, the material of the mold 14 is detached at the remaining points from the floor top 13 or the side walls of the load-bearing feet 17 to deposit above the metal sheet 12 or to be tightened thereon. This is intimated by dotted lines 19 in FIG. 1. In the final hollow floor the cavity or hollow space is between the underside of the Estrich plaster material of the floor top 13 and the remaining portion 19 of the mold 14. If the temperature of the hot air is high enough the mold 14 in total may be caused to fuse by depositing its residues also on the metal sheet 12.

Figure 3:
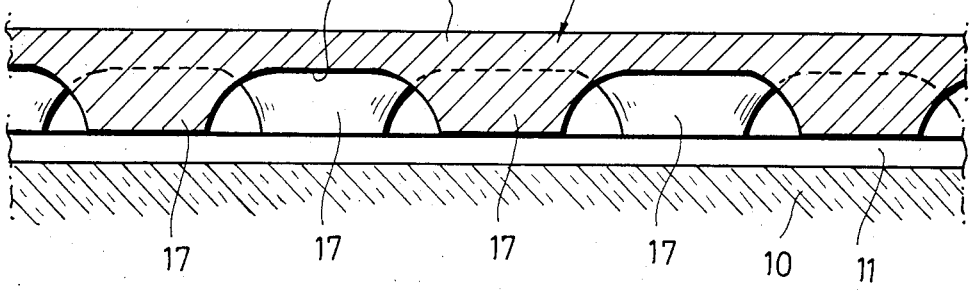
FIG. 3 is a cross section of another embodiment of the hollow floor.
Figure 4:
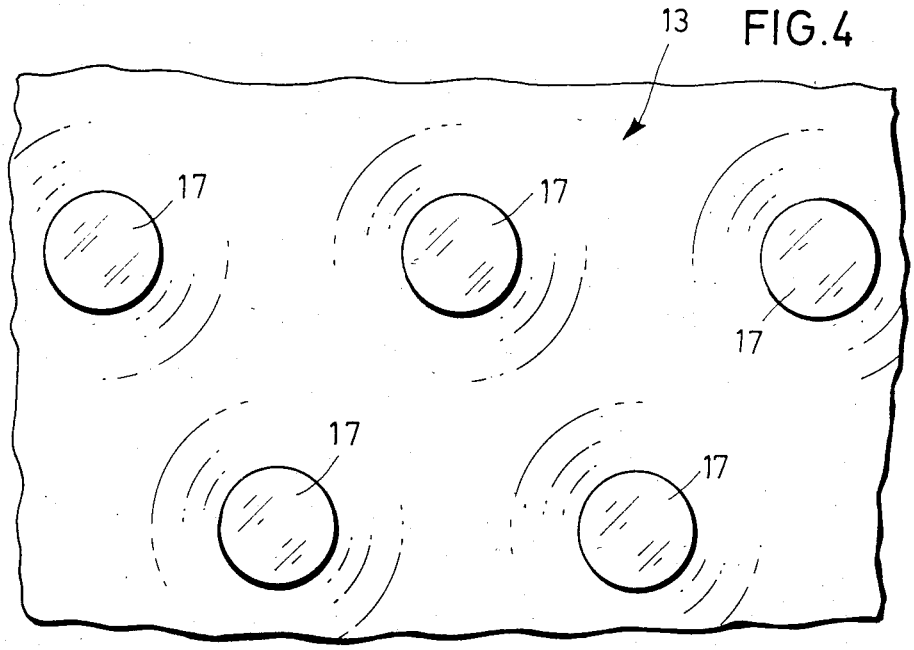
FIG. 4 is a plan view of the load-bearing feet arrangement of the hollow floor according to FIG. 3

FIGS. 3 and 4 show a hollow floor in which the feet 17 are circular knubs rather than ribs, which knubs are equally spaced from each other. Said load-bearing feet 17 are provided in rows, the load-bearing feet of two rows being staggered. As a result, a uniform bearing structure and load distribution are realised. Moreover, straight canals for the air passage are avoided within the hollow floor. The air is whirled and branched at the load-bearing feet 17 thus improving the heat transfer to the floor top 13. Between the load-bearing feet 17 there is a vault structure, in other words, the diameter of the load-bearing feet 17 is enlarged to the top, so that each load-bearing foot—seen in cross section—passes over into the adjacent load-bearing foot in the form of an arc. By such an arched structure the bearing capacity of the floor top 13 is increased and continuous surface layer 18 can be relatively thin.

Foil 26 forming the lost formwork for the floor top 13 and the load-bearing feet 17 according to FIG. 3 remains an element of the hollow floor thus enclosing the load-bearing feet 17 even upon finalisation of the hollow floor. In some regions of the hollow floor, the foil is made of plastic, in other regions of the hollow floor it is made of metal or it is a combined metal/plastic foil to influence the heat transfer from the hollow space into the material of the floor top 13.

Figure 5A:
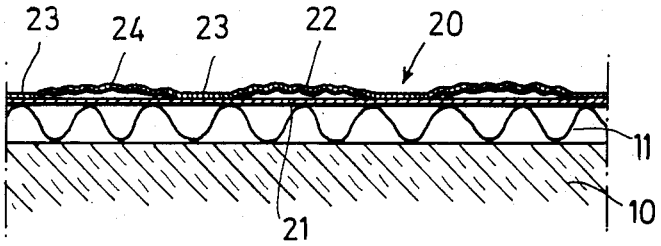
FIG. 5 shows different phases during the production of hollow floor similar to that of FIG. 3.
Figure 5B:
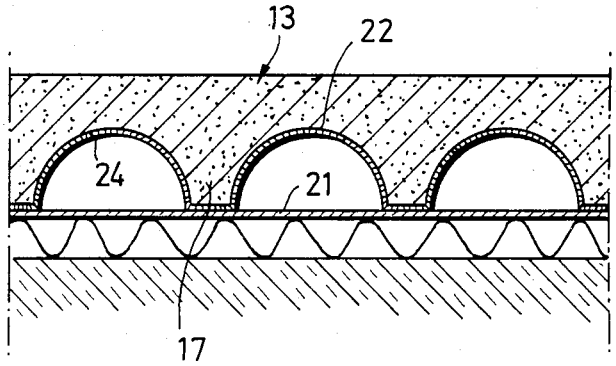
Figure 5C:
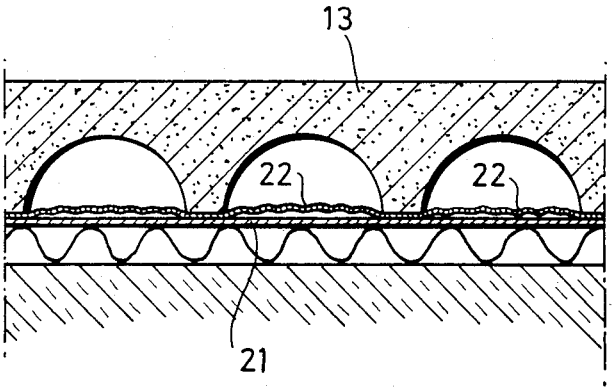

FIG. 5 shows the production of a vault structure similar to that of FIG. 3, however, by means of an example in which the formwork is removed from the floor top upon its final production.

On the floor bottom consisting of the concrete layer 10 and of the heat insulating layer 11, there is placed and bonded a double foil 20 consisting of a smooth lower web 21 and a non-self-supporting upper web 22 overlying it. The upper web 22 is welded with the plane lower web 21 at the points 23 at which the load-bearing feet 17 shall be provided later on. Between the points 23 the upper web contains bulges 24 which, in a situation as illustrated in FIG. 5*a*, are deposited on the lower web 21.

Upon the placing of the double foil 20 on the floor bottom, air is pumped between the webs 21 and 22 thus raising the bulges 24 according to FIG. 5*b*. The inflated double foil 20 according to FIG. 5*b* constitutes the formwork on which the liquid Estrich plaster is applied to form the floor top 13. It is also possible to cast the required layer thickness of liquid Estrich plaster already prior to the inflation of air. If the liquid Estrich plaster of the floor top 13 has solidified, air is evacuated form the cushion of the double foil 22. The residual air may be sucked off additionally thus causing the upper web 22 to lie on the lower web 21. The hollow space of the double floor is limited in downward direction by the randomly extending flat areas of web 22 and in upward direction by the floor top 13.

As a particular advantage of the hollow floor the heat transfering lower surface of the floor top is substantially increased with regard to a panel-type floor top so that a high heat transfer efficiency can be achieved with low temperature differences or with a reduced lower flow rate, i.e. with a reduced pressure drop in the hollow space. This is also applicable to cooling where cool air is passed through the hollow floor.

The hollow floor is also well suited for a heat or cold storage because the underside of the floor top comprises a multiple area of that of the basic plate surface.

What is claimed is:

1. A hollow floor system, comprising:

a floor bottom, a plastic mold emplaced atop said floor bottom, said mold having a plurality of integral feet and having planar portions of flexible sheet material extending between and interconnecting said feet, wherein each foot of the mold has continuous, closed side and bottom walls, each of said foot side walls having a smooth exterior, a flowable, hardenable substance poured into said mold, the weight of said substance bringing all of said feet into contact with said floor bottom, said planar portions of flexible sheet material permitting adjacent feet to yield under the weight of said substance to thereby enable each of said bottom walls of said adjacent feet to contact said floor bottom even in the event that said floor bottom is uneven, said substance when hardened thereby forming a hollow floor having a floor top supported by plural spaced load bearing legs within said mold feet, there being a hollow cavity between said floor bottom and said floor top in the regions between said legs.

2. A hollow floor system according to claim 1, characterized in that the load-bearing feet contain incorporated filling bodies.

3. A hollow floor system according to claim 1, characterized in that the floor top contains incorporated filling bodies.

4. A hollow floor system according to claim 1 characterized in that the floor bottom comprises a relatively soft insulating layer, and an overlying pressure distributing layer which is relatively hard and has a smooth upper surface, said pressure distributing layer having a plurality of holes for sound absorption.

5. A hollow floor system according to claim 1, characterized in that at least some load-bearing feet have a coating of a heat-reflecting material.

6. A hollow floor system according to claim 1, wherein the peripheral walls of the load-bearing feet enlarge continuously to the top without a sharp bend.

7. The hollow floor system of claim 1 wherein said feet are substantially evenly spatially distributed and define a plurality of generally linear passages between the floor top and the floor bottom.

8. The hollow floor system of claim 1, wherein the adjacent feet are shaped to form arches therebetween to increase the structural support provided by the feet.

9. The hollow floor system of claim 1, wherein the floor top comprises insulative filling bodies within the feet to insulate the top surface of the floor top from the floor bottom.

10. A hollow floor system according to claim 1 wherein the portion of each foot side wall near said floor bottom extends substantially vertically onto the floor bottom upper surface.

11. A hollow floor comprising:

a floor base;

a mold placed above said floor base, said mold including a rectilinear array of downward facing concave projections and a flexible sheet material extending between and interconnecting said projections;

a self-leveling, hardenable compound covering said mold and filling said concave projections, said flexible sheet material yielding under the weight of said self-leveling compound to thereby enable each of said projections to contact said floor base even in the event that said floor base is uneven.

12. A hollow floor as in claim 11 wherein said projections and said sheet material extending therebetween are unitary.

13. A process for the production of a hollow floor on a floor bottom, said process comprising the steps of:

placing on the floor bottom a formwork of a profiled flexible sheet material having a plurality of mutually spaced apart feet forms arranged in an array with generally planar portions of said flexible sheet material extending between and surrounding said feet forms, said formwork substantially adapting itself to the contour of the floor bottom, each foot form having continuous, closed side walls and a bottom wall, and each of said foot form side walls having a smooth exterior and extending from adjacent the plane of said flexible sheet to near the floor bottom and being generally vertical near said floor bottom;

filling and covering the formwork with a low viscous, flowable, self-solidifying composition which, upon its solidification, forms a floor plate with load-bearing feet within said feet forms, there being cavities between the load bearing feet through which conduits can be inserted, said flexible sheet material yielding under the weight of said composition to thereby enable each of said bottom walls of said feet forms to contact said floor bottom even in the event that said floor bottom is uneven.

14. The process of claim 13, wherein the load-bearing feet are so arranged such that the spaces between them have in one preferred direction a flow resistance to air flow lower than in other directions.

15. A process according to claim 13 comprising the further step of:

inserting at least one conduit through at least some of said cavities between said load bearing feet.

16. The process of claim 13 wherein in said formwork said feet forms are non-contiguous, and wherein said sheet material has sufficient flexibility to permit adjacent feet forms to be independently displaced vertically under the weight of said composition so as to contact an uneven floor bottom without tearing at an interface between said adjacent feet forms.

17. A process for the production of a hollow floor on a smooth floor bottom comprising the steps of:

placing a formwork of a profiled flexible thermoplastic synthetic foil having feet forms on the floor bottom, which adapts itself substantially to the contour of the floor bottom, each foot form having continuous, closed side and bottom walls, each of said foot side walls having a smooth exterior and extending substantially vertically near the floor bottom;

coating the formwork with a plastic composition which, upon its solidification, forms a floor top, load-bearing feet and hollow spaces between the load bearing feet; and after the solidification of the plastic composition, shrinking the plastic foil by heating.

18. The process of claim 17, wherein the sheet material for performing the process comprises panels or webs having regularly spaced recesses and that the edges of two adjacent panels or webs form sealable joints.

19. A process for the production of a hollow floor on a smooth floor bottom comprising the steps of:

placing a formwork of a profiled flexible sheet material having foot forms on the floor bottom, which adapts itself substantially to the contour of the floor bottom, each foot form having continuous, closed side and bottom walls, and each of said foot side walls having a smooth exterior and extending substantially vertically near the floor bottom;

coating the formwork with a substantially self-leveling plastic composition which, upon its solidification, forms a floor top, load-bearing feet and hollow spaces between the load bearing feet;

forming the formwork by placing two foils sealingly connected regionwise on the floor bottom, filling the foils with a fluid to form a cushion; and evacuating the cushion upon the solidification of the plastic composition.

20. A process for forming a hollow floor on a floor bottom comprising the steps of:

placing a flexible floor mold on the floor bottom, the mold having a plurality of downwardly extending leg forming portions to engage the floor bottom, said leg forming portions having continuous, closed side and bottom walls, each of said portion side walls having a smooth exterior and extending substantially vertically onto the floor bottom at the floor bottom; and applying a flowable substance over the mold, which subsequently hardens to form an upper floor having a plurality of legs and a plurality of spaces between the lower floor and the upper floor when the substance hardens;

wherein the floor mold is an inflatable floor mold having a lower web on the floor bottom and an upper web connected to the lower web at spaced intervals to form leg feet forming spaces when inflated, said process further comprising the steps of:

inflating the mold with a fluid to form the leg forming spaces;

applying a flowable substance over the mold to form an upper floor having a plurality of legs resting on the floor bottom when the substance hardens; and deflating the mold after the substance hardens to form a plurality of spaces between the legs.

21. A process for forming a cavity floor on a floor bottom comprising the steps of:

placing a flexible floor mold on the floor bottom, the mold having a plurality of mutually spaced downwardly extending leg forming portions to engage the floor bottom, said leg forming portions arranged in an array with generally planar portions of said flexible floor mold extending between and surrounding said leg forming portions, said leg forming portions having continuous, closed side and bottom walls, each of said portion side walls having a smooth exterior extending from said planar portions to said floor bottom; and applying a flowable substance over the mold, which subsequently hardens to form an upper floor having a plurality of legs defined by said array of leg forming portions and thereby forming an array of continuous cavities between the lower floor and the upper floor when the substance hardens, said planar portions of said flexible floor mold permitting adjacent leg forming portions each separately to contact the floor bottom under the weight of said applied substance, even if said floor bottom is uneven.

22. A process for forming a cavity floor on a floor bottom, comprising the steps of:

placing a floor mold on the floor bottom, said mold having a generally flexible planar portion depending downwardly from which are a plurality of leg forming portions, said leg forming portions being mutually separated with regions of said flexible planar portion completely surrounding each, said leg forming portions each having a continuous sidewall disposed and each having a generally planar base, said leg forming portions being arranged in an array, applying a flowable substance over the mold and into each of said leg forming portions, said flexible planar portion yielding under the weight of said substance to thereby enable the generally planar base of each of said leg forming portions to contact said floor bottom even in the event that said floor bottom is uneven, said substance subsequently hardening to form an upper floor having a plurality of legs each within a respective one of said leg forming portions, and resultantly to form a network of continuous cavities between the lower floor and the upper floor.

* * * * *